US005161261A

United States Patent [19]

Kamata

[11] Patent Number: 5,161,261

[45] Date of Patent: Nov. 10, 1992

[54] HELMET HAVING SHIELD

[75] Inventor: Eitaro Kamata, Tokyo, Japan

[73] Assignee: Shoei Kako Kabushiki Kaisha, Tokyo, Japan

[21] Appl. No.: 745,666

[22] Filed: Aug. 16, 1991

[30] Foreign Application Priority Data

Mar. 18, 1991 [JP] Japan ..... 3-15708[U]

[51] Int. Cl.[5] ..... A42B 3/18

[52] U.S. Cl. ..... 2/424; 2/6; 2/425

[58] Field of Search ..... 2/6, 7, 8, 9, 15, 171, 2/173, 184.5, 205, 206, 410, 423, 424, 425

[56] References Cited

U.S. PATENT DOCUMENTS

| | | | |
|---|---|---|---|
| 1,131,350 | 3/1915 | Engelfried | 2/424 |
| 3,362,403 | 1/1968 | Fleming | 2/6 |
| 3,440,661 | 4/1969 | Newcomb | 2/8 |
| 4,047,249 | 9/1977 | Booth | 2/424 |
| 4,101,980 | 7/1978 | Stepan | 2/424 |
| 4,455,687 | 6/1984 | Johansson | 2/424 |
| 4,475,248 | 10/1984 | L'Abbe | 2/424 |
| 4,748,696 | 6/1988 | Fohl | 2/424 |
| 4,907,300 | 3/1990 | Dampney | 2/424 |
| 5,062,162 | 11/1991 | Kamata | 2/425 |

FOREIGN PATENT DOCUMENTS

| | | | |
|---|---|---|---|
| 2339353 | 8/1977 | France | 2/424 |
| 2610484 | 8/1988 | France | 2/424 |

*Primary Examiner*—Werner H. Schroeder
*Assistant Examiner*—Diana L. Biefeld
*Attorney, Agent, or Firm*—Armstrong & Kubovcik

[57] ABSTRACT

A recess is provided in the inner surface of a primary shield plate which is connected to a cap body of a helmet through a pivotal mounting means, and a step depressed from the inner surface of the primary shield plate is formed at the entire peripheral edge of an opening of the recess. An inner shield plate is fitted to the step and bonded thereto with a soft adhesive, so that a heat insulating space tightly closed in the recess is defined by the primary shield plate and the inner shield plate. The inner surfaces of the primary shield plate and the inner shield plate are formed into a continuous surface which comes into close contact with a sealing member provided at a peripheral edge of a window opening in the cap body. This ensures that clouding of the inner surface of the shield can be prevented regardless of conditions of use such as the presence and absence of travel wind and the temperature of the open air.

5 Claims, 6 Drawing Sheets

HELMET HAVING SHIELD

BACKGROUND OF THE INVENTION

1. Field of the Invention

The field of the present invention is helmets of a type having a shield and used primarily by an occupant on a snowmobile, a motorcycle or the like, and particularly, improvements in helmets of a type having its shield attached at left and right ends thereof to a cap body through a pivotal mounting means for opening and closing a window opening formed in a front surface of the cap body.

2. Description of the Prior Art

It is already known that when such a helmet is in use with the shield fully closed, travel wind produced by travelling of a vehicle is directed to an inner surface of the shield in order to prevent a cloud of the inner surface of the shield which may occur due to expiration of a user (for example, see Japanese Patent Application Laid-open No. 159507/88).

However, such a helmet suffers from a problem that during stoppage of the vehicle where there is no travel wind, a cloud is liable to be produced on the inner surface of the shield, and in use in a cold district, a cloud may be produced on the inner surface of the shied due to a large difference in temperature between the shield cooled by the outside air and the inside of the cap body.

SUMMARY OF THE INVENTION

Accordingly, it is an object of the present invention to provide a helmet wherein a cloud on an inner surface of a shield can be prevented regardless of condition such as the presence and absence of travel wind and the temperature of the open air.

To achieve the above object, according to the present invention, there is provided a helmet comprising a cap body and a shield attached at left and right ends thereof to the cap body through a pivotal mounting means for opening and closing a window opening made in a front surface of the cap body, wherein the shield is comprised of a primary shield plate connected at left and right ends thereof to the pivotal mounting means and having a recess in an inner surface, and an inner shield plate fitted and coupled to a step which is formed at an entire peripheral edge of an opening of the recess and is depressed from the primary shield plate, with a heat insulating space being defined in the recess by the primary shield plate and the inner shield plate, the primary shield plate and said inner shield plate having inner surfaces formed into a continuous surface coming into close contact with a sealing member provided on a peripheral edge of the window opening.

With the above feature of the present invention, by the fitting and coupling of the inner shield plate to the step, both the plates can be correctly coupled to each other in a given relationship, so that the heat insulating space having a predetermined function is reliably defined between both the plates. Thus, the heat of the inner shield plate can be kept by the heat insulating space and hence, a cloud of the inner surface of the shield can be prevented regardless of conditions of use such as the presence and absence of travel wind and the temperature of the open air. In addition, because the inner surfaces of the primary shield plate and the inner shield plate are formed as a continuous surface, the inner surface of the shield can be brought reliably into close contact with the sealing member at the peripheral edge of the window opening to tightly close the window opening, whenever the shield is fully closed. That is, even if a boundary line between the primary shield plate and the inner shield plate reaches the sealing member due to errors in fabrication and assembling of the pivotal mounting means, the function of the sealing member is maintained. Further, the primary shield plate is connected to the pivotal mounting plate, so that substantially no loae is applied to the inner shield plate. Therefore, it is possible to provide a reduction in wall thickness of the inner shield plate and hence, a reduction in weight of the shield.

The above and other objects, features and advantages of the invention will become apparent from a reading of the following description of the preferred embodiment, taken in conjunction with the accompanying drawings.

BRIEF DESCRIPTION OF THE DRAWINGS

The drawings illustrate one embodiment of the present invention, wherein.

DESCRIPTION OF THE PREFERRED EMBODIMENT

The present invention will now be described by way of one embodiment in connection with the accompanying drawings.

Figure 1:
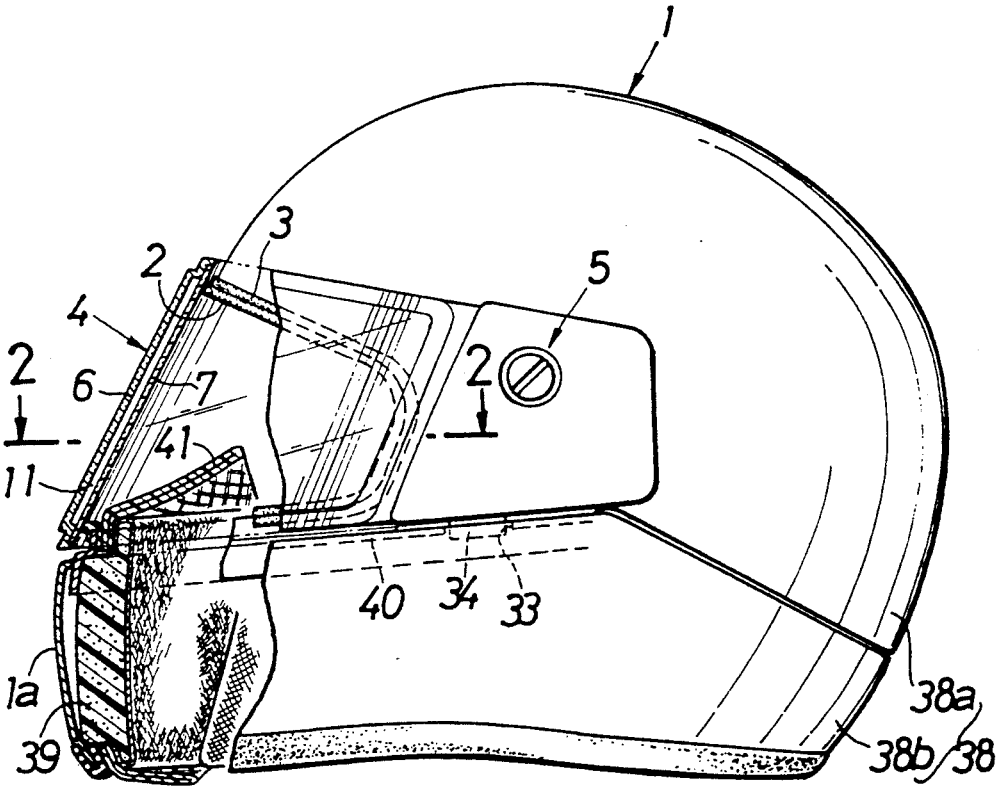
FIG. 1 is a partially broken side view of a helmet having a shield.

Referring first to FIG. 1, a cap body 1 of a helmet is constructed into a full-face type having a chin-covering portion 1*a* immediately below a window opening 2 in a front surface thereof. A sealing member 3 made of rubber is fitted into and bonded to a peripheral edge of the window opening 2. A shield 4 is vertically movably mounted at its left and right opposite ends to the cap body 1 through a pivotal mounting means 5 to open and close the window opening 2. The shield 4 has an inner surface adapted to come into close contact with the sealing member 3 at a lowering limit to close the window opening 2, and is curved forwardly at a central portion to extend along a front profile of the cap body 1.

As shown in FIGS. 1 to 3 and 5, the shield 4 is comprised of a thick primary shield plate 6 and a thin inner shield plate 7. A knob 6*a* is projectingly provided on a lower end of the primary shield plate 6. A recess 8 is provided in an inner surface of the primary shield plate 6 at a location corresponding to the window opening 2, and moreover, a step 9 is formed at the entire peripheral edge of an opening of the recess 8 and depressed from the inner surface of the primary shield plate 6. The step 9 has a depth set at a level equal to or slightly deeper than a thickness of the inner shield plate 7. The entire peripheral edge of the inner shield plate 7 is matched to the step 9 and bonded thereto with a soft adhesive. A heat insulating space 11 tightly closed in the recess 8 is defined by the inner shield plate 7 and the primary shield plate 6. At the same time, a continuous surface 12 is formed on the inner surfaces of the primary shield plate 6 and the inner shield plate 7 and capable of reliably coming into close contact with the sealing member 3.

Each of the primary shield plate 6 and the inner shield plate 7 is formed of synthetic resin having high transparency and a low refractive index, e.g., any of polycarbonate, acrylic, and polyvinyl chloride resins. A transparent anti-cloud or anti-fogging film 13 is formed on each of an inner surface of the recess 8 of the primary shield plate 6 and inner and outer surfaces of the inner shield plate 7.

The pivotal mounting means 5 for connecting the left and right ends of the shield 4 will be described below in connection with FIGS. 4 to 6. The left and right pivotal mounting means 5 have the same structures and hence, the left pivotal mounting means 5 will be described as a representative.

The pivotal mounting means 5 comprises a base plate 14 secured to a side of the cap body 1, an end plate 16 secured to an end of the primary shield plate by an eyelet 15, and a cover 17 covering the end plate 16 and supporting the end plate 16 for pivotal movement by cooperation with the base plate 14. Each of the pase plate 14 and the end plate 16 is formed from synthetic resin having high resistances to wear and shock, e.g., any of polyacetal, nylon and ABS.

A pair of through-holes 18 and 19 are provided in the base plate 14 at a vertical distance therebetween, and nuts 20 and 21 are embedded in the cap body 1 in correspondence to the through-holes 18 and 19. The base plate 14 is secured to the cap body 1 by screwing machine screws 22 and 23 inserted through the through-holes 18 and 19 into the nuts 20 and 21.

A cylindrical pivot 24 is projectingly provided on an outer side of the base plate 14 to concentrically surround the upper through-hole 18, and a pivot hole 25 is provided in the end plate 16 and rotatably fitted by the pivot 24. Further, a stationary stopper 26 and a locating pin 27 are projectingly provided on the outer side of the base plate 14 at its upper and lower portions, respectively, and a movable stopper 28 is formed on the end plate 16 for defining the fully-opened position of the shield 4 by cooperation with the stationary stopper 26.

Projectingly provided on an inner side of the cover 17 are a cylindrical retainer 29 fitted over an outer periphery of a tip end of the pivot 24 to restrain the axial movement of the end plate 16, and a cylindrical spacer 30 abutting against the base plate 14 within the cylindrical retainer 29. The hollow of the cylindrical spacer 30 is a through-hole 31 coaxially aligned with the above-described through-hole 18. Thus, the cover 17 is secured to the cap body 1 together with the base plate by inserting the machine screw 22 even through the through-hole and screwing it into the nut 20.

Further formed in the cover 17 are a cylindrical locating member 32 fitted over the locating pin 27, and a projection piece 34 engaged into an engage hole 33 in the outer side of the cap body 1. Thus, the rotation of the cover 17 about the pivot 24 can be inhibited by fitting of the locating pin 27 in the cylindrical locating member 32, and the fitting of the locating pin 27 in the cylindrical locating member 32 can be maintained, while preventing the outward flexing of a lower portion of the cover 17 by engagement between the engage hole 33 and the projection piece 34.

A click stop mechanism 35 is provided between the base plate 14 and the end plate 16 for retaining the shield 4 at any of its fully-closed position, a plurality of middle opened positions and its fully-opened position. The click stop mechanism 35 comprises several stationary click teeth 36— projectingly provided on the outer side of the base plate 14 radially about the pivot 24, and a large number of movable click teeth 37— projectingly provided on the inner side of the end plate 16 radially about the pivot hole 25. The click teeth 36— and 37— are disengageably engaged with each other under the influence of resilient forces of the base plate 14 and the end plate 16.

Figure 4:
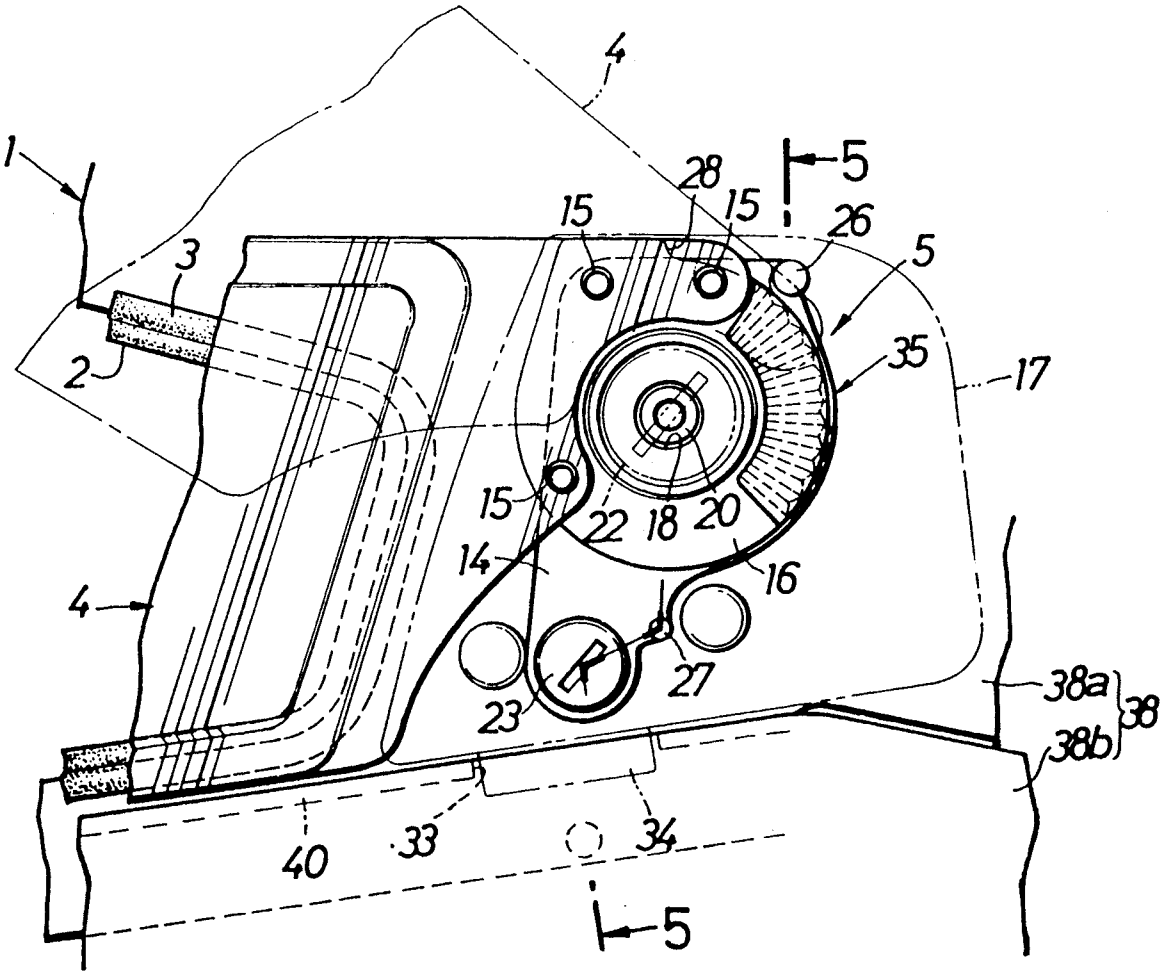
FIG. 4 is an enlarged side view of a pivotal mounting means shown in FIG. 1.
Figure 5:
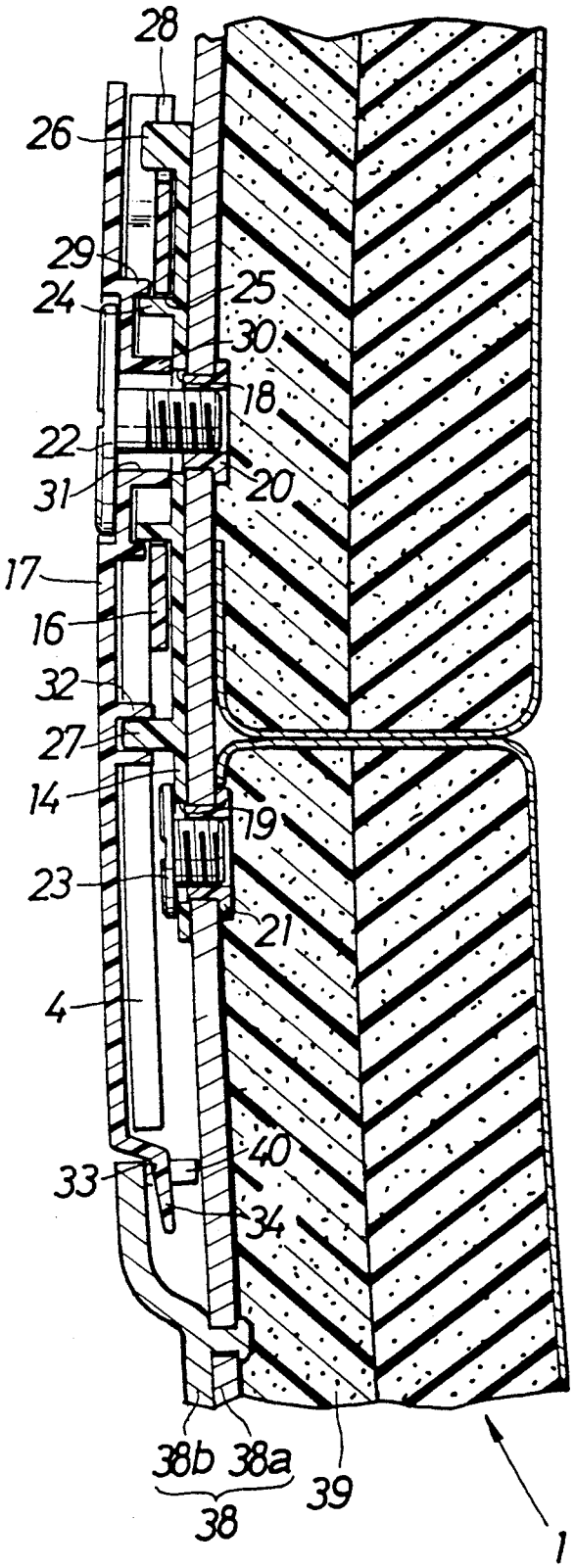
FIG. 5 is a sectional view taken along a line 5—5 in FIG. 4.
Figure 6:
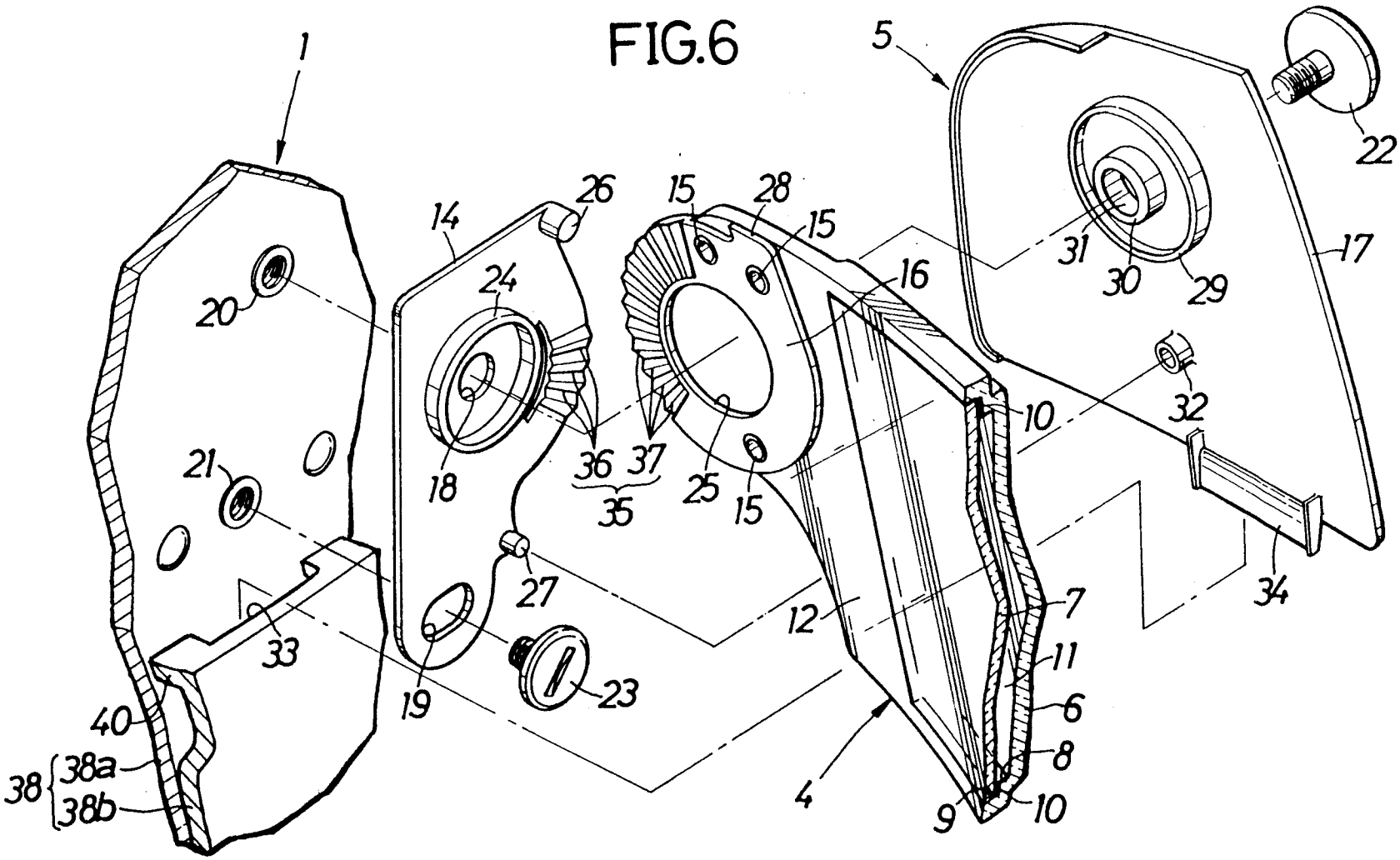
FIG. 6 is an exploded perspective view of the pivotal mounting means.

As shown in FIGS. 4 and 5, the cap body 1 is comprised of a shell 38 made of FRP and a shock-absorbing liner 39 made of foamed polystylene and bonded to an inner surface of the shell 38. The shell 38 is divided at a location corresponding to the middle of the chin-covering portion 1*a* into an upper shell portion 38*a* and a lower shell portion 38*b*, which are superposed at their divided ends to each other with the lower shell portion 38*b* being outside and are rivetted to each other. In this case, the engage hole 33 is defined between the upper and lower shell portions 38*a* and 38*b* by cutting-out of a portion of an inwardly bent collar 40 at an upper end of the lower shell portion 38*b*.

Figure 2:
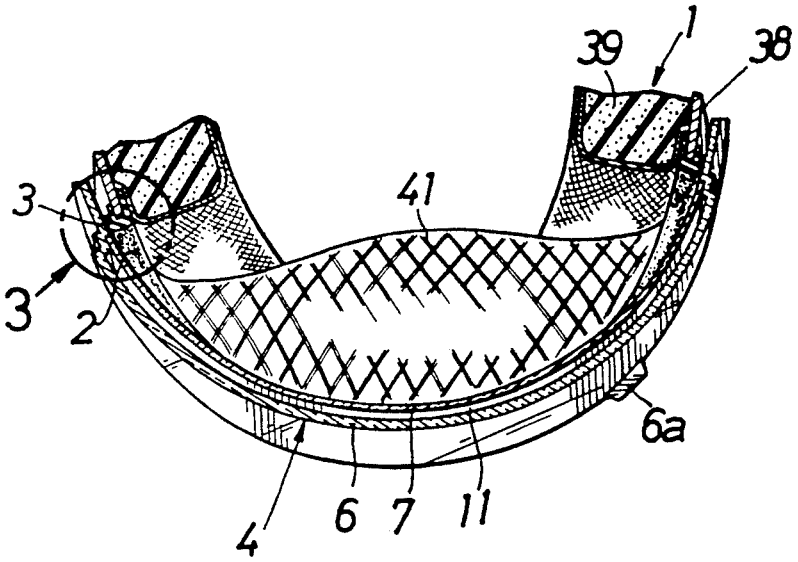
FIG. 2 is a sectional view taken along a line 2—2 in FIG. 1.
Figure 3:
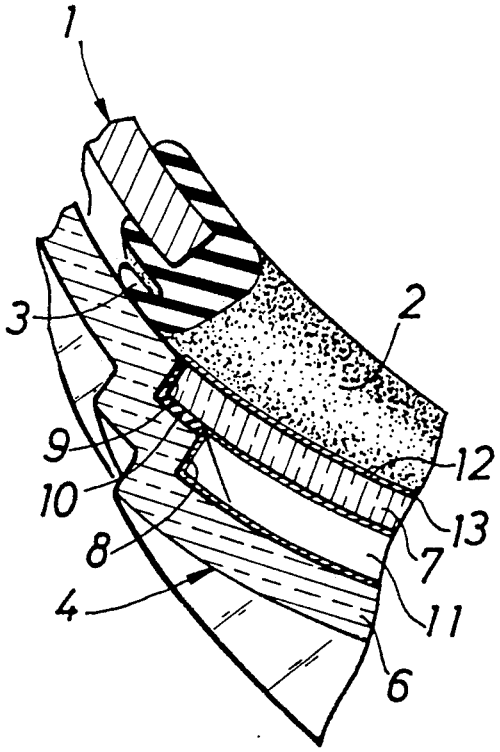
FIG. 3 is an enlarged view of a portion indicated by 3 in FIG. 2.

As shown in FIGS. 1 and 2, a soft expiration guide plate 41 is added to an upper edge of the chin-covering portion 1*a* of the cap body 1 to project inwardly of the cap body 1 and is adapted to deflect the expiration from a user downwardly to substantially prevent it from directly touching an inner surface of the shield 4.

The operation of this embodiment will be described below.

When the helmet of the present invention is used with the shield fully opened in cold districts or regions, even if the outer primary shield plate 6 is cooled by the outside air, transfer or conduction of a heat from the innter shield plate 7 to the primary shield plate 6 is inhibited by the heat insulating space 11 and the adhesive 10, so that the inner shield plate 7 can be maintained at a temperature substantially equal to that in the cap body 1, thereby preventing clouding or fogging of the inner surface of the inner shield plate 7 due to a large difference in temperature.

Moreover, since the anti-cloud film 13 is formed on the inner surface of the inner shield plate 7, even if a portion of the expiration air from the user flows past the expiration-air guide plate 41 to touch the inner shield plate 7, clouding due to this can be also prevented.

Further, since the anti-cloud film 13 is also formed on the inner surface of the primary shield plate 6 and the outer surface of the inner shield plate 7 which face to the heat insulating space 11, even if moisture should be contained in the air within the heat insulating space 11, clouding due to such moisture can be likewise prevented.

Yet further, since the inner shield plate 7 is fitted into and coupled to the step 9 formed at the entire peripheral edge of the opening of the recess 8 in the primary shield plate 6, the plates 6 and 7, even if they are curved as described above, can be coupled in an exact relation position to define the heat insulating space 11 with an even thickness at every location in the recess 8 during fabrication of the shield 4. Therefore, the heat insulating function of the heat insulating space 11 can be stablized even in mass production.

Since the inner surfaces of the primary shield plate 6 and the inner shield plate 7 are formed into the continuous surface 12 by fitting the peripheral edge of the inner shield plate 7 to the step 9, even if the sealing member 3 at the peripheral edge of the window opening 2 comes into contact with any part of the inner surface of the shield 4, the window opening 2 can be reliably and tightly closed. This ensures that errors in fabrication and assembling of the pivotal mounting means 5 or the like are substantially allowable.

To open and close the shield 4, a wearer of the helmet grasps the knob 6*a* of the primary shield plate 6 and moves it vertically. During this time, the end plate 16 coupled to the primary shield plate 6 is pivotally moved about the pivot 24 of the base plate 14, while at the same time, the stationary and pivotable click teeth 36 and 37 of the click stop mechanism 35 are changed in engaged positions step by step, so that the shield 4 can be retained at a desired opened position by new engagement of both the click teeth 36 and 37.

A strain may be somewhat produced in the primary shield plate 6 due to a load of the pivotal mounting means 5 during such opening and closing of the shield 4, but such strain is absorbed into the soft adhesive 10 and extremely rarely spread to the inner shield plate 7, ensuring that the peel-off of the plates 6 and 7 from each other can be prevented. In addition, from the fact that the strain is rarely spread to the inner shield plate 7, it is not necessary to provide a large strength to the inner shield plate 7, and there is no inconvenience even if the inner shield plate 7 is formed thinner than the primary shield plate 6. This makes it possible to provide a reduction in weight of the shield 4 by reducing the wall thickness of the inner shield plate 7.

What is claimed is:

1. A helmet comprising a cap body and a shield attached at left and right ends thereof to the cap body through a pivotal mounting means for opening and closing a window opening made in a front surface of the cap body, wherein said shield includes a primary shield plate connected at left and right ends thereof to the pivotal mounting means, a recess being made on an inner surface of the primary shield plate, an inner shield plate being coupled to said primary shield plate to define a heat insulating space in said recess between said primary shield plate and said inner shield plate, a step being made to be depressed from the inner surface of the primary shield plate at an entire peripheral edge of an opening of said recess, for receiving the inner shield plate so as to form inner surfaces of the primary and inner shield plate into a continuous surface coming into close contact with a sealing member provided on a peripheral edge of said window opening.

2. A helmet according to claim 1, wherein the inner shield plate has a wall thickness less than that of the primary shield plate and is bonded to said step of the primary shield plate through a soft adhesive.

3. A helmet according to claim 1 or 2, further including a transparent anti-cloud film formed on the inner surface of said inner shield plate.

4. A helmet according to claim 3, wherein the transparent anti-cloud film is also formed on each of those surfaces of said primary and inner shield plates which face said heat insulating space.

5. A helmet according to claim 1, wherein said pivotal mounting means comprises a base plate having a pivot on an outer surface thereof and secured to a side of the cap body, an end plate secured to an end portion of the primary shield plate and pivotally supported on said pivot, and a cover for covering said end plate and supporting said end plate for pivotal movement by cooperation with said base plate, and said helmet further includes a click stop mechanism provided between said base plate and said end plate for retaining the shield stepwise between a fully-opened and a fully-closed position.

* * * * *